US010221598B2

(12) United States Patent
Dolman

(10) Patent No.: US 10,221,598 B2
(45) Date of Patent: Mar. 5, 2019

(54) HINGE

(71) Applicant: Assa Abloy Limited, West Midlands (GB)

(72) Inventor: Terry Dolman, West Midlands (GB)

(73) Assignee: Assa Abloy Limited, West Midlands (GB)

( * ) Notice: Subject to any disclaimer, the term of this patent is extended or adjusted under 35 U.S.C. 154(b) by 0 days.

(21) Appl. No.: 15/440,204

(22) Filed: Feb. 23, 2017

(65) Prior Publication Data

US 2017/0247920 A1 Aug. 31, 2017

(30) Foreign Application Priority Data

Feb. 25, 2016 (GB) ..... 1603310.2
Mar. 24, 2016 (GB) ..... 1605098.1

(51) Int. Cl.
*E05D 5/02* (2006.01)
*E05D 7/06* (2006.01)
(Continued)

(52) U.S. Cl.
CPC ..... *E05D 7/0045* (2013.01); *E05D 3/02* (2013.01); *E05D 5/02* (2013.01); *E05D 11/0054* (2013.01); *E05Y 2600/10* (2013.01); *E05Y 2600/502* (2013.01); *E05Y 2900/132* (2013.01); *E05Y 2900/148* (2013.01)

(58) Field of Classification Search
CPC ..... Y10T 16/5321; Y10T 16/5322; Y10T 16/53225; Y10T 16/53235; E05D 7/0045; E05D 7/0009; E05D 3/02; E05D 5/02; E05D 5/0215; E05D 5/0223; E05D 5/023; E05D 11/0054; E05Y 2600/10; E05Y 2600/502; E05Y 2900/132; E05Y 2900/148
See application file for complete search history.

(56) References Cited

U.S. PATENT DOCUMENTS 1,517,205 A * 11/1924 Flagg ..... E05D 3/02 16/384
2,624,067 A * 1/1953 Tassell ..... E05D 5/065 16/389
(Continued)

FOREIGN PATENT DOCUMENTS

CN 201666064 12/2010
CN 203968508 11/2014
(Continued)

OTHER PUBLICATIONS

Search Report for corresponding Great Britain Application No. GB1603310.2 dated May 12, 2017, 6 pages.
(Continued)

*Primary Examiner* — Chucky Y Mah
(74) *Attorney, Agent, or Firm* — Dinsmore & Shohl LLP

(57) ABSTRACT

A hinge is provided, which comprises: at least one hinge pin defining a hinge axis in a first dimension; a hinge leaf; a housing comprising at least one recess for receiving a portion of the hinge leaf; and at least one user adjustable fastener arranged to enable user adjustment of the positioning of the hinge leaf within the at least one recess in a second dimension, wherein the second dimension is orthogonal to the first dimension.

20 Claims, 11 Drawing Sheets

(51) Int. Cl.

| | |
|---|---|
| ***E05D 7/00*** | (2006.01) |
| ***E05D 3/02*** | (2006.01) |
| ***E05D 11/00*** | (2006.01) |

(56) References Cited

U.S. PATENT DOCUMENTS 3,172,167 A * 3/1965 Tugle ..... E05D 3/02 16/389
3,439,377 A * 4/1969 Bucholz ..... E05D 5/065 16/389
5,150,500 A * 9/1992 Bisbing ..... E05D 5/0215 16/239
5,224,241 A 7/1993 Williams
5,339,493 A * 8/1994 MacIntyre ..... E05D 7/0423 16/237
5,472,271 A * 12/1995 Bowers ..... E05D 5/065 16/391
5,491,873 A * 2/1996 Ferguson ..... E05D 7/0423 16/235
5,694,665 A * 12/1997 Strickland ..... E05D 7/0423 16/237
5,713,105 A * 2/1998 Toomey ..... E05D 7/0423 16/238
5,799,370 A * 9/1998 Davidian ..... E05D 7/0415 16/236
6,285,565 B1 * 9/2001 Angberg ..... H02G 3/26 174/64
7,334,293 B2 * 2/2008 Erickson ..... E05D 7/0423 16/243
7,703,178 B2 * 4/2010 Lee ..... E05D 5/02 16/382
8,720,008 B2 * 5/2014 Dodge ..... E05D 7/0423 16/245
2004/0034969 A1 * 2/2004 Wegman ..... E05D 5/06 16/389
2004/0128794 A1 * 7/2004 Chung ..... E05D 7/0423 16/236
2008/0022491 A1 * 1/2008 Campbell ..... E05D 7/0423 16/236
2008/0209679 A1 * 9/2008 Erickson ..... E05D 7/0423 16/245
2009/0077767 A1 3/2009 Alchin
2011/0107222 A1 5/2011 Uchida et al.
2011/0107555 A1 5/2011 Buchanan et al.
2013/0014345 A1 * 1/2013 Park ..... E05D 5/06 16/248
2013/0243524 A1 * 9/2013 Oetlinger ..... E05D 5/0238 403/335
2016/0047151 A1 * 2/2016 Pelekanos ..... E05D 7/0045 16/238

FOREIGN PATENT DOCUMENTS

| | | |
|---|---|---|
| CN | 204060277 | 12/2014 |
| CN | 204850825 | 12/2015 |
| DE | 102010004772 | 1/2011 |
| EP | 2186980 | 5/2010 |
| EP | 2997861 | 3/2016 |
| GB | 2433771 | 7/2007 |
| NL | 8800506 A | 9/1989 |
| WO | WO 2014/161024 | 10/2014 |

OTHER PUBLICATIONS

Search Report for corresponding Great Britain Application No. GB1605098.1 dated May 18, 2017, 2 pages.

* cited by examiner

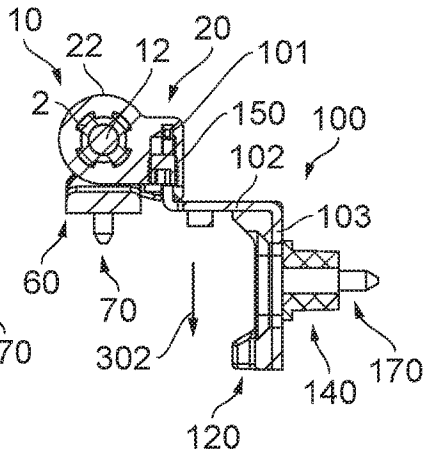
FIG. 8A
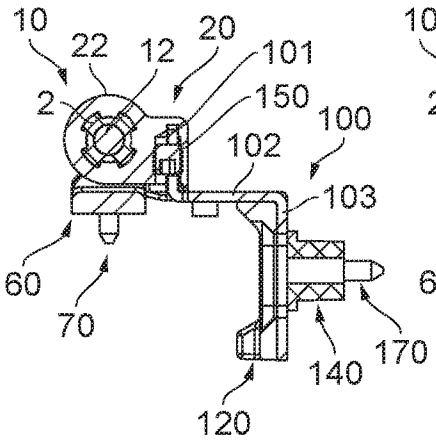
FIG. 8B
FIG. 8C
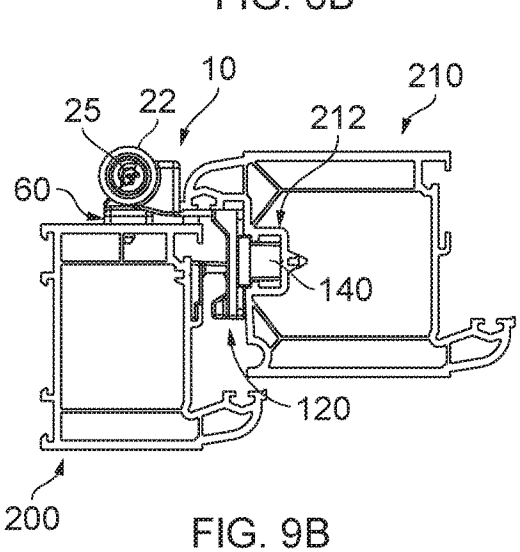
FIG. 9A
FIG. 9B
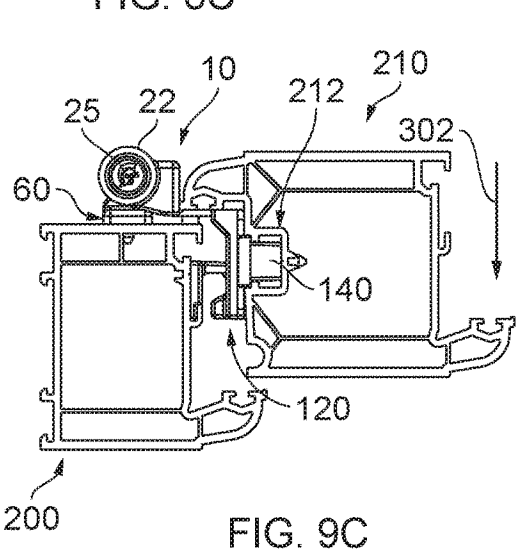
FIG. 9C

HINGE

CROSS-REFERENCE TO RELATED APPLICATIONS

This application claims priority to GB Application Nos. 1603310.2, filed Feb. 25, 2016 and 1605098.1, filed Mar. 24, 2016, the entire contents of which are incorporated herein by reference.

TECHNOLOGICAL FIELD

Embodiments of the present invention relate to a hinge. In particular, they relate to a slim hinge for a door or a window with a compression adjustment.

BACKGROUND

Modern door arrangements incorporate seals which are compressed between the door/window sash and the surrounding frame when the door/window is closed. Consequently, it is necessary for the hinges to ensure that the door/window sash adopts the appropriate position when closed, in order to provide correct compression of the sealing arrangements. Appropriate door positioning will also improve the aesthetics.

BRIEF SUMMARY

According to various, but not necessarily all, embodiments of the invention there is provided a hinge, comprising: at least one hinge pin defining a hinge axis in a first dimension; a hinge leaf; a housing comprising at least one recess for receiving a portion of the hinge leaf; and at least one user adjustable fastener for enabling user adjustment of the positioning of the hinge leaf within the at least one recess in a second dimension, wherein the second dimension is orthogonal to the first dimension.

According to various, but not necessarily all, embodiments of the invention there is provided a hinge, comprising: at least one hinge pin defining a hinge axis in a first dimension; a hinge leaf; a housing comprising at least one recess for receiving a portion of the hinge leaf; and adjustment means, for adjusting the positioning of the hinge leaf within the at least one recess in a second dimension in response to user adjustment, wherein the second dimension is orthogonal to the first dimension.

The adjustment means may comprise at least one user adjustable fastener arranged to fasten the portion of the hinge leaf into at least one recess. The at least one user adjustable fastener may be configured to respond to user adjustment by adjusting the positioning of the hinge leaf within the at least one recess in a second dimension.

The at least one user adjustable fastener may be at least one threaded fastener. The at least one recess may comprise at least one thread for receiving the at least one threaded fastener.

The hinge leaf may be non-planar. The hinge leaf may comprise a first portion that is for reception by the recess, and a second portion that extends from the first portion in a third dimension, the third dimension being orthogonal to the first dimension and the second dimension.

The first portion may be substantially planar and the second portion may be substantially planar. The first portion and the second portion may together define an L-shaped cross section.

The hinge leaf may further comprise a third portion that extends from the second portion in the second dimension. The third portion is substantially planar. The second portion and the third portion may together define an L-shaped cross section.

The hinge may further comprise one or more apertures for use in fixing the hinge leaf to a sash. A corner interface between the second portion and the third portion may comprise one or more apertures for use in fixing the hinge leaf to a sash.

The hinge may further comprise at least one sleeve for housing at least a portion of the at least one hinge pin. The housing may comprise the at least one sleeve. The at least one sleeve may comprise a first sleeve and a second sleeve for housing at least a portion of at least one hinge pin. The hinge may further comprise a mountable body positioned between the first sleeve and the second sleeve, wherein the housing is configured to rotate about the hinge axis relative to the mountable body.

The hinge may further comprise a mount for mounting the hinge to a frame, wherein the mountable body is configured to engage with the mount. Engagement of the mount and mountable body may define a user adjustable mounting axis for the hinge.

The mount may comprise a first clamping surface for engaging with a second clamping surface of the mountable body. The first clamping surface may comprise teeth for engaging with teeth of the mountable body. The hinge may further comprise at least one fastener for clamping the first clamping surface to the second clamping surface.

The mountable body may comprise an aperture through which the at least one fastener is arranged to extend. The aperture may be shaped to enable the position of the at least one fastener, within the aperture, to be user adjustable in the first dimension. The at least one fastener may be arranged to fasten at a position within the mount. The at least one fastener may be threaded and may be shaped to fasten into a threaded aperture within the mount.

According to various, but not necessarily all, embodiments of the invention there is provided a hinge, comprising: at least one hinge pin defining a hinge axis; and a hinge leaf, rotatable about the hinge axis, comprising a corner interface between a portion of the hinge leaf and a further portion of the hinge leaf, wherein at least one aperture is provided in the corner interface for fixing the hinge leaf in place using a fastener.

The corner interface may comprise a plurality of apertures for fixing the hinge leaf in place using a plurality of fasteners. The plurality of apertures may include a first aperture spaced from a second aperture, along the corner interface, in a first dimension. The hinge axis may extend in the first dimension. The first dimension may be a vertical dimension when the hinge leaf orientated for fixing to a sash.

The further portion of the hinge leaf may extend from the portion of the hinge leaf in a second dimension, substantially orthogonal to the first dimension.

The hinge leaf may be non-planar. The portion of the hinge leaf may be substantially planar. The further portion of the hinge leaf may be substantially planar. The portion and the further portion of the hinge leaf may define an L-shaped cross-section.

The hinge may further comprise a clamp plate. The clamp plate may comprise at least one aperture arranged for alignment with the at least one aperture in the corner interface of the hinge leaf.

According to various, but not necessarily all, embodiments of the invention there is provided a hinge, comprising:

at least one hinge pin defining a hinge axis, extending in a first dimension; and a hinge leaf, rotatable about the hinge axis, comprising a corner interface between a portion of the hinge leaf and a further portion of the hinge leaf, a plurality of apertures being provided in the corner interface for fixing the hinge leaf in place using a plurality of fasteners, each aperture being spaced from another in the first dimension, and wherein each aperture is shaped to enable a fastener to pass therethrough at an angle of substantially 45 degrees, relative to the portion and the further portion of the hinge leaf, in a plane defined in second and third dimensions, each of the first, second and third dimensions being substantially orthogonal to each other.

According to various, but not necessarily all, embodiments of the invention there is provided a hinge, comprising: at least one hinge pin defining a hinge axis in a first dimension; a hinge leaf; a housing comprising at least one recess for receiving a portion of the hinge leaf; and adjustment means, for adjusting the positioning of the hinge leaf within the at least one recess in a second dimension in response to user adjustment, wherein the second dimension is orthogonal to the first dimension.

The adjustment means may comprise at least one user adjustable fastener arranged to fasten the portion of the hinge leaf into at least one recess. The at least one user adjustable fastener may be configured to respond to user adjustment by adjusting the positioning of the hinge leaf within the at least one recess in a second dimension.

The at least one user adjustable fastener may be at least one threaded fastener. The at least one recess may comprise at least one thread for receiving the at least one threaded fastener.

The hinge leaf may be non-planar. The hinge leaf may comprise a first portion that is for reception by the recess, and a second portion that extends from the first portion in a third dimension, the third dimension being orthogonal to the first dimension and the second dimension.

The first portion may be substantially planar and the second portion may be substantially planar. The first portion and the second portion may together define an L-shaped cross section.

The hinge leaf may further comprise a third portion that extends from the second portion in the second dimension. The third portion is substantially planar. The second portion and the third portion may together define an L-shaped cross section.

The hinge may further comprise one or more apertures for use in fixing the hinge leaf to a sash. A corner interface between the second portion and the third portion may comprise one or more apertures for use in fixing the hinge leaf to a sash.

The hinge may further comprise at least one sleeve for housing at least a portion of the at least one hinge pin. The housing may comprise the at least one sleeve. The at least one sleeve may comprise a first sleeve and a second sleeve for housing at least a portion of at least one hinge pin. The hinge may further comprise a mountable body positioned between the first sleeve and the second sleeve, wherein the housing is configured to rotate about the hinge axis relative to the mountable body.

The hinge may further comprise a mount for mounting the hinge to a frame, wherein the mountable body is configured to engage with the mount. Engagement of the mount and mountable body may define a user adjustable mounting axis for the hinge.

The mount may comprise a first clamping surface for engaging with a second clamping surface of the mountable body. The first clamping surface may comprise teeth for engaging with teeth of the mountable body. The hinge may further comprise at least one fastener for clamping the first clamping surface to the second clamping surface.

The mountable body may comprise an aperture through which the at least one fastener is arranged to extend. The aperture may be shaped to enable the position of the at least one fastener, within the aperture, to be user adjustable in the first dimension. The at least one fastener may be arranged to fasten at a position within the mount. The at least one fastener may be threaded and may be shaped to fasten into a threaded aperture within the mount.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

Figure 7:
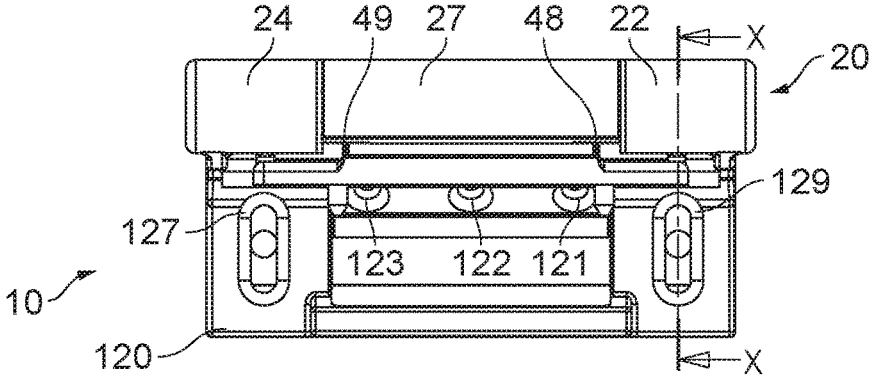
FIG. 7 illustrates a side elevation of the hinge.
Figure 10C:
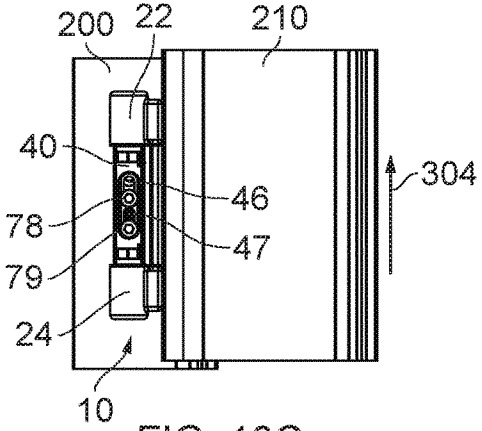
Figure 10B:
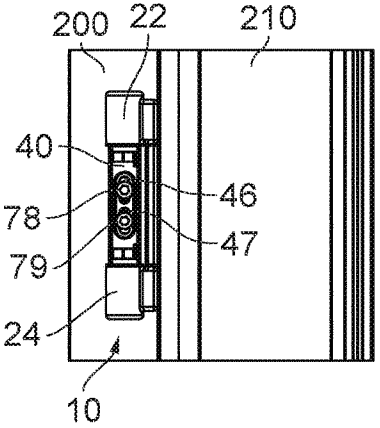
Figure 10A:
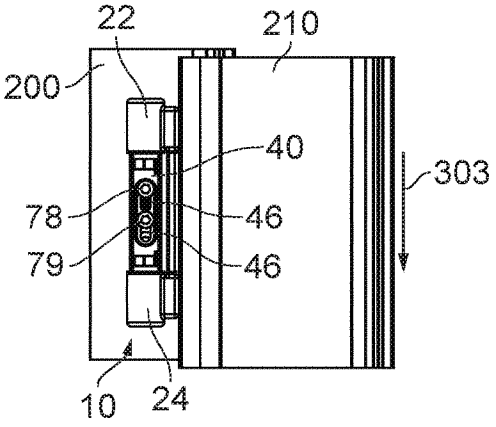
Figure 11C:
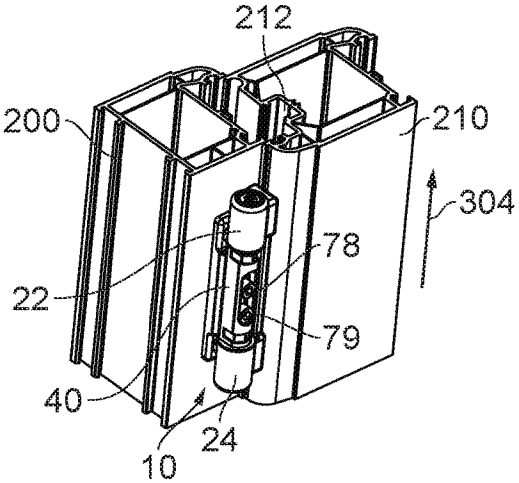
Figure 11B:
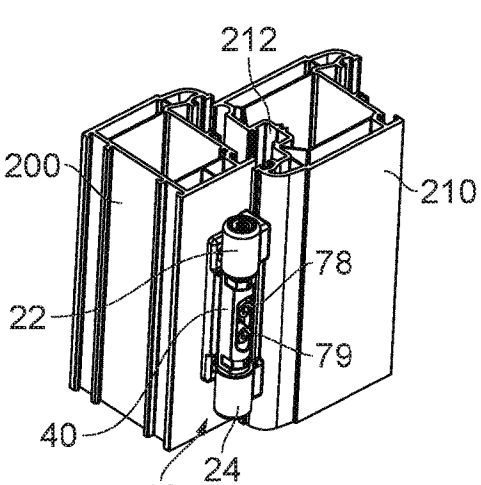
Figure 11A:
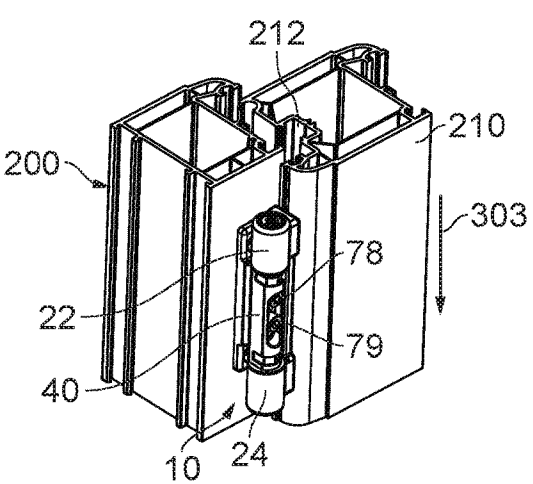
Figure 12A:
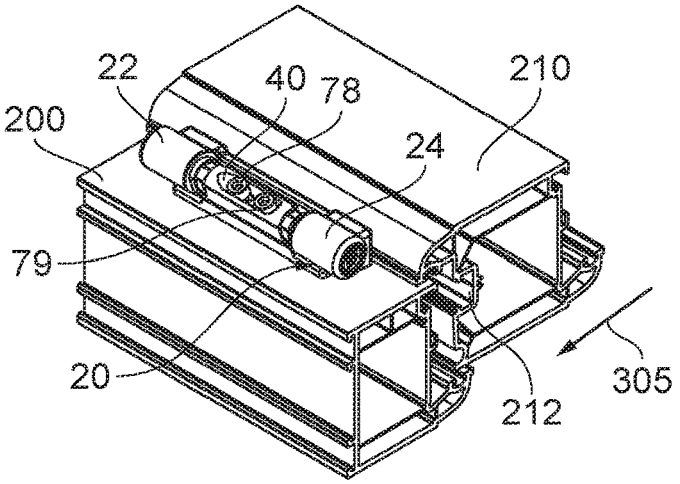
Figure 12B:
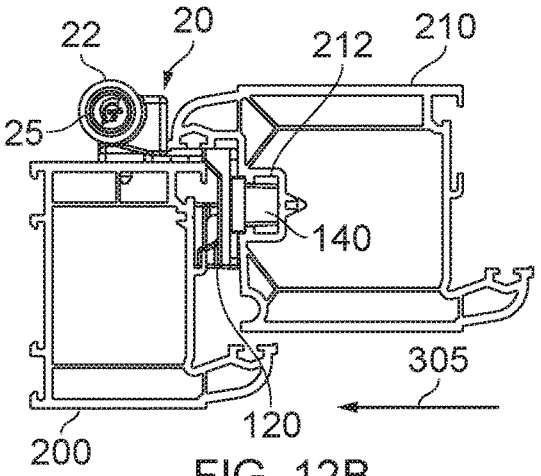
Figure 12C:
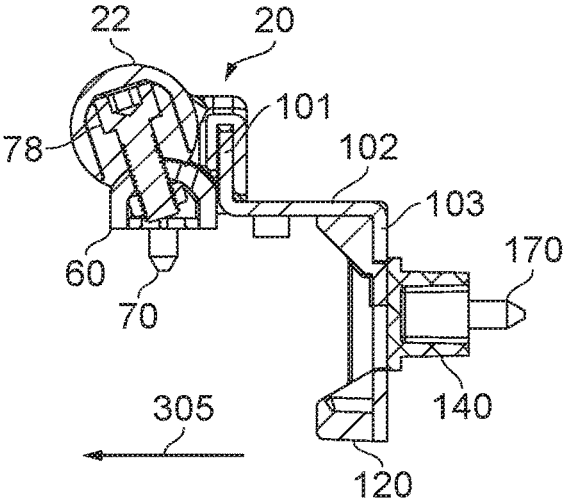
Figure 13A:
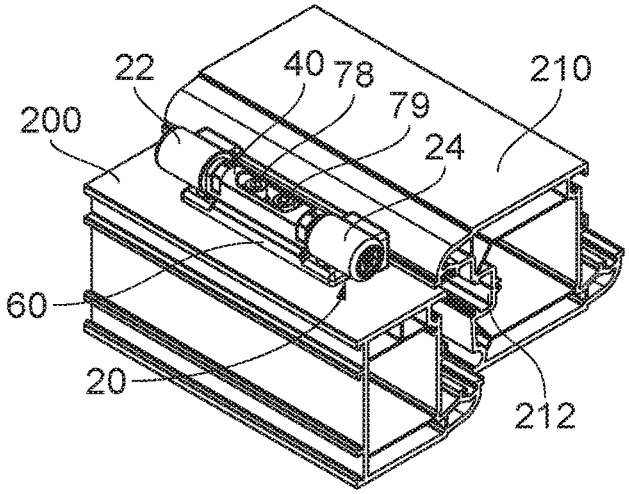
Figure 13B:
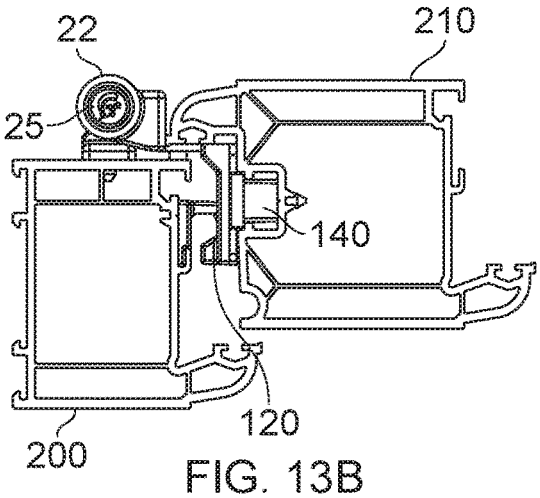
Figure 13C:
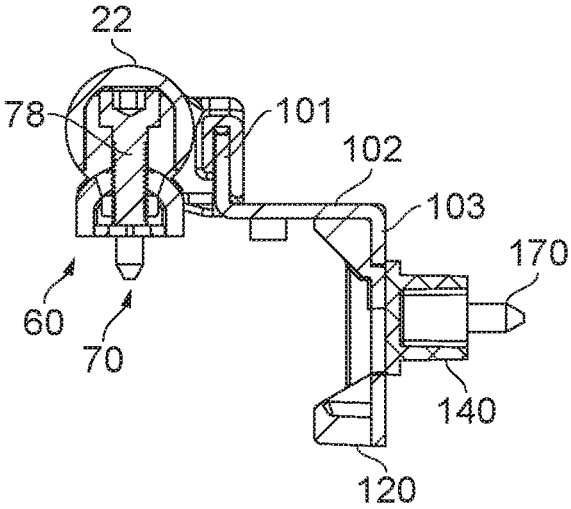
Figure 14A:
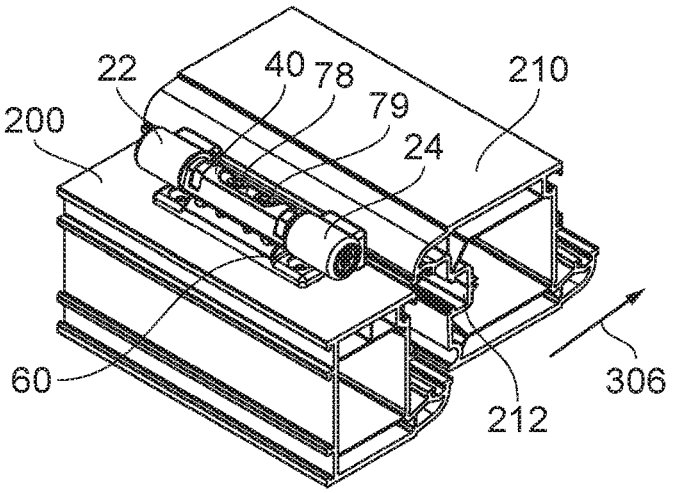
Figure 14B:
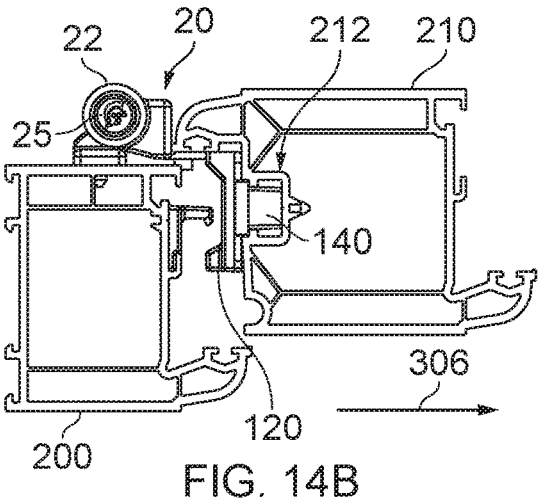
Figure 14C:
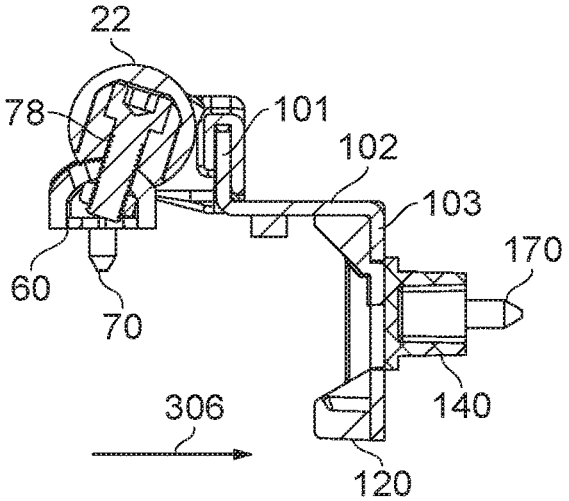

FIGS. 8A, 8B and 8C each illustrate a cross-section of the hinge through the line X-X illustrated in FIG. 7 in a different compression adjustment position;

FIG. 9A illustrates a plan view of the hinge in situ, which corresponds with the cross-sectional view of the hinge illustrated in FIG. 8A;

FIG. 9B illustrates a plan view of the hinge in situ, which corresponds with the cross-sectional view of the hinge illustrated in FIG. 8B;

FIG. 9C illustrates a plan view of the hinge in situ, which corresponds with the cross-sectional view of the hinge illustrated in FIG. 8C;

FIGS. 10A, 10B and 10C each illustrate a front elevation of the hinge in situ, in a different vertical adjustment position;

FIG. 11A illustrates a perspective view of the hinge in situ, which corresponds with the front elevation illustrated in FIG. 10A;

FIG. 11B illustrates a perspective view of the hinge in situ, which corresponds with the front elevation illustrated in FIG. 10B;

FIG. 11C illustrates a perspective view of the hinge in situ, that corresponds with the front elevation illustrated in FIG. 10C;

FIGS. 12A, 12B and 12C illustrate a perspective view, a plan view and a cross-sectional view respectively of the hinge in a first lateral adjustment position;

FIGS. 13A, 13B and 13C illustrate a perspective view, a plan view and a cross-sectional view respectively of the hinge in a second lateral adjustment position; and FIGS. 14A, 14B and 14C illustrate a perspective view, a plan view and a cross-sectional view of the hinge in a third lateral adjustment position.

DETAILED DESCRIPTION

Embodiments of the present invention relate to a slim hinge 10 for a door or a window. The hinge 10 enables a door or a window sash to be moved relative to a frame in three orthogonal dimensions in order to ensure that the door is correctly fitted. The hinge 10 enables the door to move vertically relative to the frame (vertical adjustment), horizontally relative to the frame (lateral adjustment) and towards and away from the frame (compression adjustment).

Figure 1:
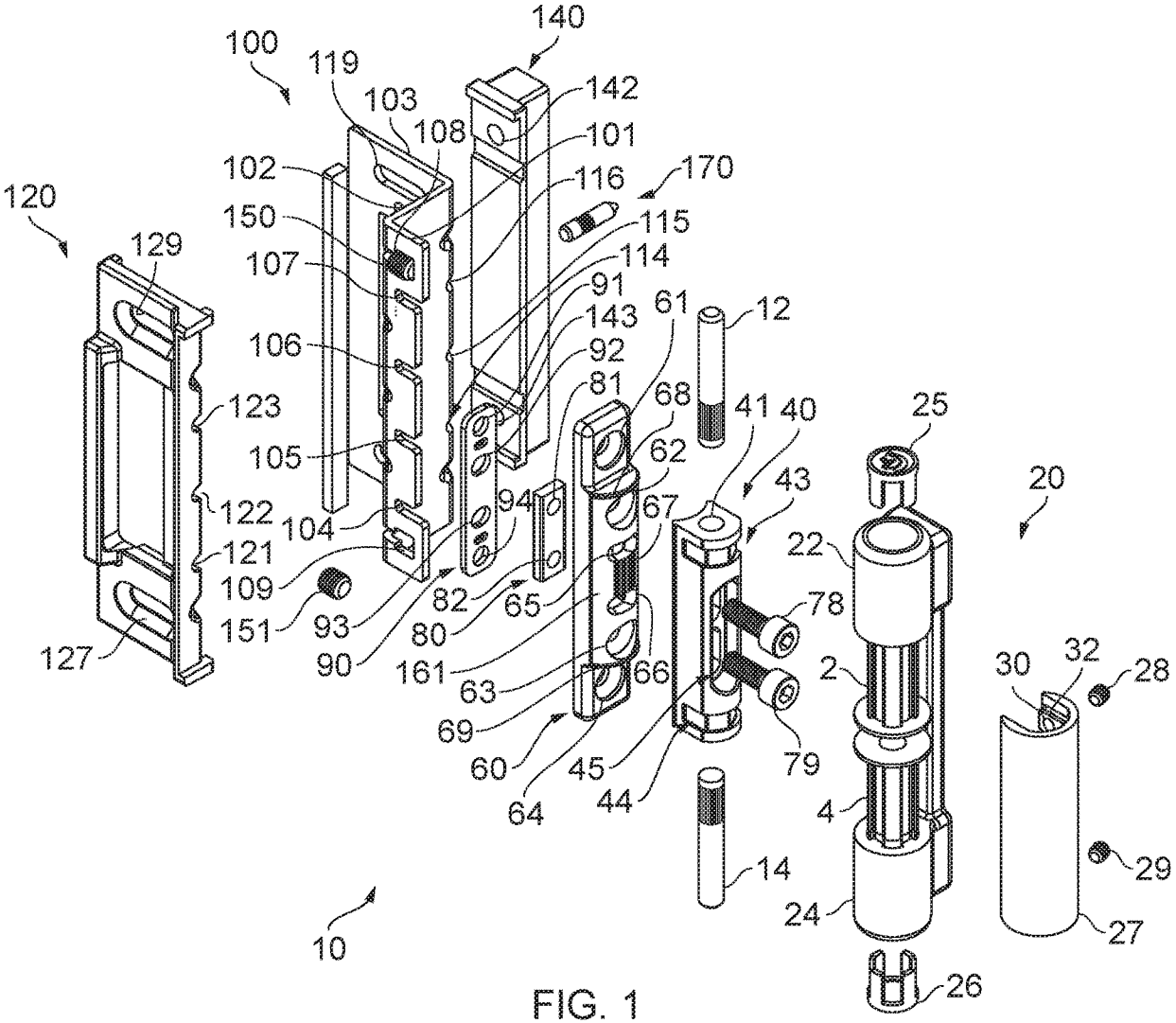
FIG. 1 illustrates an exploded view of a hinge.

FIG. 1 illustrates an exploded view of the hinge 10. The hinge 10 comprises a cover 27, a housing 20, a mountable body 40, first and second hinge pins 12, 14, a mount 60, a first insert 80 for the mount 60, a second insert 90 for the mount 60, a hinge leaf 100, a clamp plate 120 and a clamp block 140.

The mount 60 is arranged to mount the hinge 10 on a frame, such as a door frame or a window frame. The mount 60 comprises first, second, third and fourth apertures 61-64 that may be used to fasten the mount 60 to a door frame. For example, a fastener, such as a screw, may be inserted through each of the fasteners 61-64 to fasten the mount 60 to a frame. The mount 60 further comprises a fifth aperture 65 and sixth aperture 66. The fifth aperture 65 is for receiving a first fastener 78 and the sixth aperture 66 is for receiving a second fastener 79. In this example, each of the first and second fasteners 78, 79 is a threaded fastener in the form of a bolt.

The first insert 80 for the mount 60 is substantially rectangular in shape and comprises first and second threaded passages 81, 82. The first insert 80 is configured to be positioned in a recess at the rear of the mount 60 which is not visible in FIG. 1. When the first insert 80 is positioned within the recess in the mount 60, the first threaded passage 81 is positioned to receive the first fastener 78 which passes through the fifth aperture 65 in the mount 60, and the second threaded passage 82 in the first insert 80 is positioned to receive the second fastener 79 which passes through the sixth aperture 66 in the mount 60.

The second insert 90 is also arranged to be positioned within the recess at the rear of the mount 60. When the second insert 90 is positioned in the recess at the rear of the mount 60, the first insert 80 is positioned between the fifth and sixth apertures 65, 66 in the mount 60 and the second insert 90. A first aperture 91 in the second insert 90 is arranged for alignment with the second aperture 62 in the mount 60, such that a fastener may pass through the second aperture 62 in the mount 60 and the first aperture 91 in the second insert 90. A second aperture 92 in the second insert 90 is arranged for alignment with the threaded passage 81 in the first insert 80 and the fifth aperture 65 in the mount 60 such that the first fastener 78 may pass through them. A third aperture 93 in the second insert 90 is arranged for alignment with the second aperture 82 in the first insert 80 and the sixth aperture 66 in the mount 60, such that the second fastener 79 may pass through them. A fourth aperture 94 in the second insert 90 is arranged for alignment with the third aperture 63 in the mount 60, such that a fastener may pass through them.

A set of teeth 67, extending in a vertical dimension, are positioned between the fifth and sixth apertures 65, 66 in the mount 60 in this example. The mount 60 also comprises a first ridge 68 and a second ridge 69 in the illustrated example. In the illustration, the first and second ridges 68, 69 are curved. The teeth 67, the ridges 68, 69 and the second, third, fifth and sixth apertures 62, 63, 65, 66 are provided on a curved surface 161 of the mount 60 that is configured to engage with a curved surface 141 of the mountable body 40. This is described in further detail below.

Figure 2A:
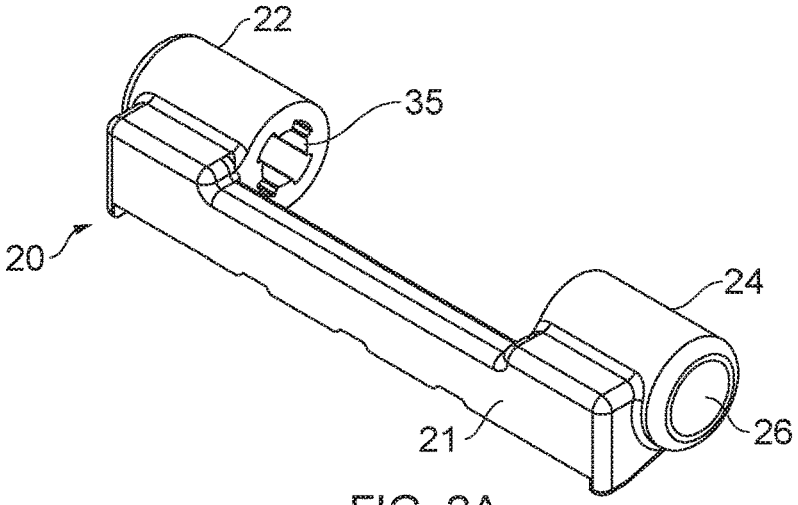
FIGS. 2A, 2B and 2C illustrate a first perspective view, a second perspective view and a plan view of a housing of the hinge respectively.
Figure 2B:
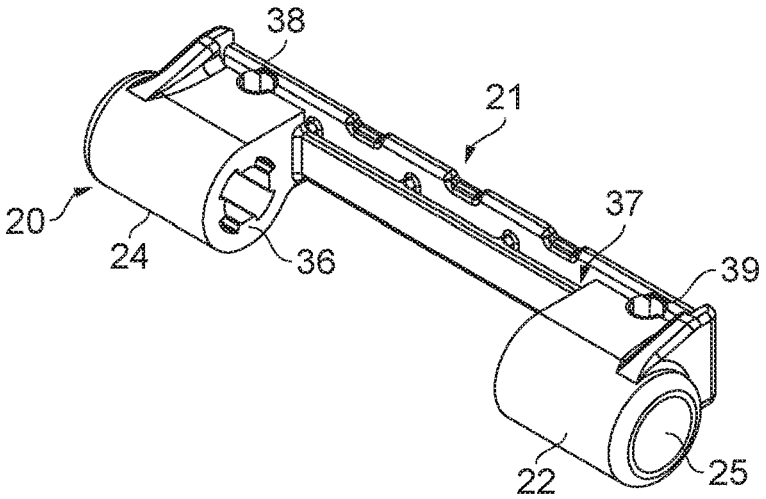
Figure 2C:
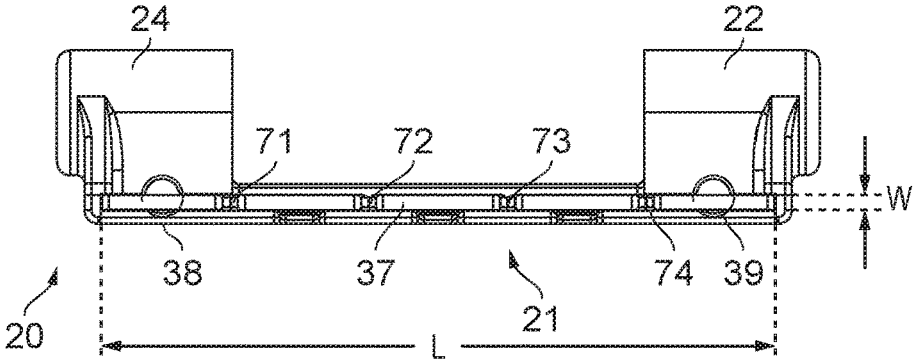

FIGS. 2A, 2B and 2C illustrate a first perspective view, a second perspective view and a plan view of the housing 20 respectively. The housing 20 comprises a first sleeve 22 and a second sleeve 24. The first sleeve 22 comprises a first passage 35 for receiving a first hinge pin bush 2 (illustrated in FIG. 1) and the second sleeve 24 comprises a second passage 36 for receiving a second hinge pin bush 4 (illustrated in FIG. 1). Each of the first and second hinge pin bushes 2, 4 defines a passage for a hinge pin 12, 14.

The housing 20 further comprises an intermediate portion 21 that connects the first sleeve 22 and the second sleeve 24. The intermediate portion 21 comprises an elongate recess/slot 37. In this example, the elongate recess 37 includes a plurality of protrusions 71-74 and first and second threaded recesses 38, 39 that are positioned either side of the plurality of protrusions 71-74.

The elongate recess 37 has a length that extends in a first (vertical) dimension, and a depth that extends in a second (depth) dimension. The width of the elongate recess 37 extends in a third (lateral) dimension. Each of the first, second and third dimensions are orthogonal to one another. The arrows marked with the letter "L" in FIG. 2C indicate the length of the elongate recess 37 and the arrows marked with the letter "W" indicate the width of the elongate recess 37. The depth of the elongate recess 37 is into the page in FIG. 2C.

Figure 3A:
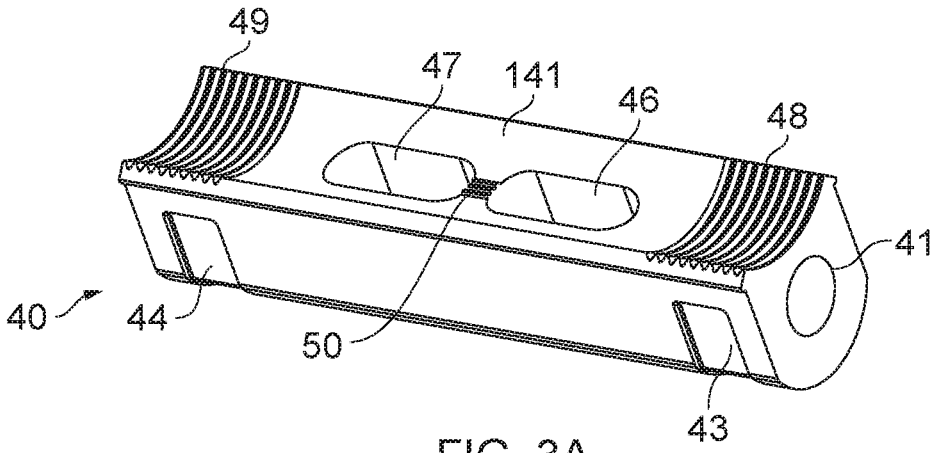
FIGS. 3A, 3B and 3C illustrate a first perspective view, a second perspective view and a plan view of a mountable body of the hinge respectively.
Figure 3B:
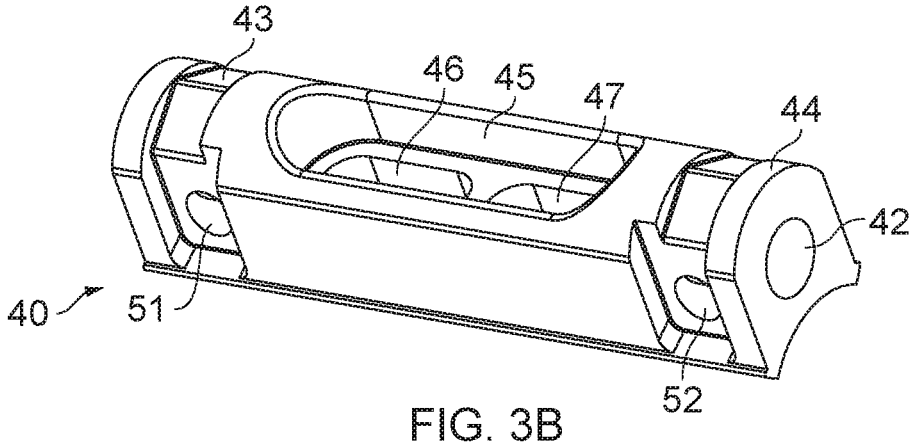
Figure 3C:
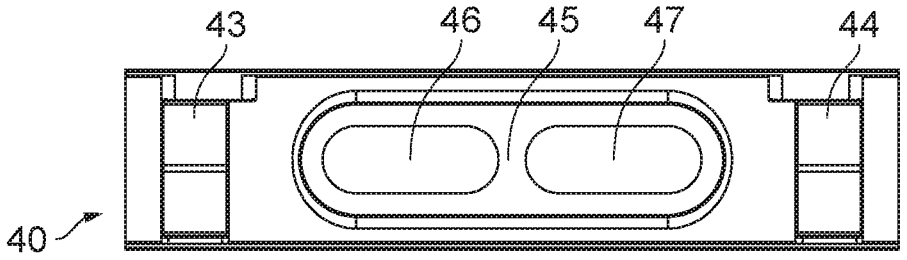

FIGS. 3A, 3B and 3C illustrate a first perspective view, a second perspective view and a plan view of the mountable body 40 respectively. The mountable body 40 comprises a first passage 41 and a second passage 42 for receiving a portion of the first hinge pin 12 and a portion of the second hinge pin 14 respectively. In the illustrated example, the first and second passages 41, 42 are substantially cylindrical in shape.

A portion of the first hinge pin 12 extends along the passage defined by the first hinge pin bush 2 and a further portion of the first hinge pin 12 extends through the first passage 41 in the mountable body 40. Similarly, a portion of the second hinge pin 14 extends through the passage defined by the second hinge pin bush 4 and a portion of the second hinge pin 14 extends through the second passage 42 in the mountable body 40. The first and second hinge pins 12, 14 are free to rotate within the first and second hinge pin bushes 2, 4 but are secured within the first and second passages 41, 42 of the mountable body 40. The housing 20 is therefore rotatable about the hinge pins 12, 14, relative to the mountable body 40.

The first and second hinge pins 12, 14 define a hinge axis in the first (vertical) dimension about which the hinge 10 may rotate a door/window sash, relative to a frame, that is interconnected with the rotatable housing 20.

The cover 27 comprises first and second protrusions that are arranged to engage with the first and second recesses 43, 44 in the mountable body 40. Each of the protrusions in the cover 27 comprises an aperture for a fastener. For example, the apertures may be threaded apertures for set screws. One of the protrusions is labelled with the reference numeral 32 in FIG. 1. The aperture therein is labelled with the reference numeral 30. First and second fasteners 28, 29, for fixing the cover 27 in place are illustrated in FIG. 1. In this example, the fasteners 28, 29 which extend through the apertures in the cover 27 and into side apertures 51, 52 in the mountable body 40. A portion of each of the hinge pins 12, 14 may limit the movement of the fasteners 28, 29 into the mountable body 40.

The mountable body 40 further comprises a third recess 45 with first and second apertures 46, 47 therein. The third recess 45 is provided on a curved surface 141 of the mountable body 40. The first and second apertures 46, 47 are arranged to receive the first and second fasteners 78, 79 respectively, but are oversized in the first (vertical) dimension relative to the cross-section size of the fasteners 78, 79. The oversized apertures 46, 47 enable the mountable body 40 to be mounted to the mount 60, by a user, at different positions in the first (vertical) dimension. This is described in further detail below. It can be seen from FIGS. 3A, 3B and 3C that the first and second apertures 46, 47 are through-holes in the mountable body 40.

The curved surface 141 of the mountable body 40 may be secured against the mount 60 using the first and second fasteners 78, 79. The fastening of the fasteners 78, 79 into the threaded apertures 81, 82 in the first insert 80 positioned within the mount 60 causes a clamping action to be performed in which the opposing curved surfaces 141, 161 of the mountable body 40 and the mount 60 are drawn together, as a head of each fastener 78, 79 acts on an area around each of the apertures 46, 47 in the third recess 45.

The curved surface 141 of the mountable body 40 further comprises first, second and third sets of teeth 48, 49, 50. The first set of teeth 48 and the second set of teeth 49 are configured to engage with the first ridge 68 and the second ridge 69 of the mount 60 in a manner that enables the mountable body 40 to move vertically (in the first dimension) with a small amount of frictional resistance, and in a manner that enables it to rotate relative to the mount 60 while the two are in contact, prior to the mountable body 40 being fastened against the mount 60 using the fasteners 78, 79.

The fixing of the mountable body 40 against the mount 60 defines a mounting axis for the hinge 10. The mounting axis extends in the first (vertical) dimension and is parallel to the hinge axis defined by the first and second hinge pins 12, 14.

The third set of teeth 50 is positioned between the first aperture 46 and the second aperture 47. The third set of teeth 50 is configured to engage with the set of teeth 67 of the mount 60. In this example, the first and second sets of teeth 48, 49 are positioned at opposite extremities of the mountable body 40, and either side of the apertures 46, 47. The third set of teeth 50 are configured to engage with the teeth 57 of the mount 60. The engagement is such that the mountable body 40 may be rotated relative to the mount 60 while the two are in contact, prior to the mountable body 40 being fastened to the mount 60.

The curved nature of the surfaces 141, 161 of the mountable body 40 and the mount 60 enables the mountable body 40 to be fixed against the mount 60, by a user, in different positions in the third (lateral) dimension. This is described in further detail below.

Figure 4A:
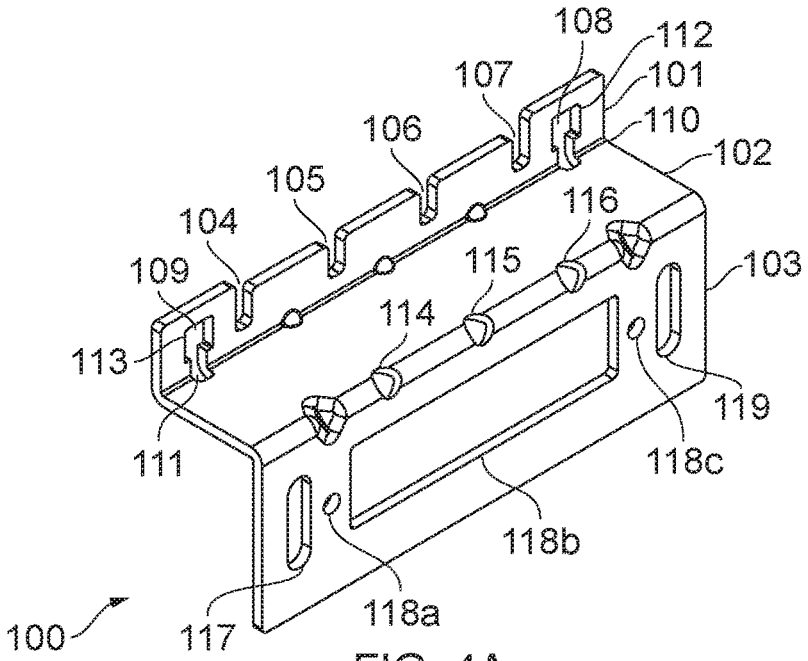
FIG. 4A illustrates a perspective view of a hinge leaf of the hinge.

FIG. 4A illustrates a perspective view of the hinge leaf 100. The hinge leaf 100 is non-planar in shape. The hinge leaf 100 comprises a first portion 101, a second portion 102 and a third portion 103. The first portion 101 is for reception by the recess 37 in the intermediate portion 21 of the housing 20. The first portion 101 of the hinge leaf 100 comprises a plurality of recesses 104-107 for receiving the protrusions 71-74 in the recess 37 of the housing 20. The presence of the recesses 104-107 and the protrusions 71-74 provides a strong interlock between the hinge leaf 100 and the housing 20 when the two are fastened together.

The first portion 101 of the hinge leaf 100 further comprises first and second apertures 108, 109, each of which is for housing a user-adjustable fastener 150, 151. The first aperture 108 comprises a wide portion 112 for receiving a fastener 150 and a narrow portion 110 for enabling a user to interact with the fastener 150 with a tool, such as an Allen key. The second aperture 109 comprises a wide portion 113 and a narrow portion 111. The wide portion 113 is for housing a fastener 151 and the narrow portion 111 is for enabling a user to interact with that fastener 151 using a tool, such as an Allen key. The fasteners 150, 151 are visible in FIG. 1.

The first portion 101 of the hinge leaf 100 may be secured in the elongate recess 37 of the housing 20 by fixing the user-adjustable fasteners 150, 151 in the threaded recesses 38, 39 while the user-adjustable fasteners 150, 151 also reside in the (wide portions 112, 113 of) the apertures 108, 109. The position of the fasteners 150, 151 in the threaded recesses 38, 39 may be adjusted by a user in order to adjust the position of the first portion 101 of the hinge leaf 100 in the elongate recess 37. User adjustment of the fasteners 150, 151 adjusts the position of the hinge leaf 100 in the second (depth) dimension. This is described in further detail below.

The combination of the fasteners 150, 151, the apertures 108, 109 and the threaded recesses 38, 39 may be considered to be adjustment means for adjusting the position of the hinge leaf 100 within the recess 37 in the second (depth) dimension.

The second portion 102 of the hinge leaf 100 extends from the first portion 101 of the hinge leaf 100. The third portion 103 of the hinge leaf 100 extends from the second portion 102 of the hinge leaf 100. In this example, each of the portions 101-103 of the hinge leaf 100 is substantially planar.

The plane defined by the planar nature of the first portion 101 of the hinge leaf 100 extends in the first (vertical) and second (depth) dimensions. The plane defined by the planar nature of the second portion 102 of the hinge leaf 100 extends in the first (vertical) and third (lateral) dimensions. The plane defined by the planar nature of the third portion 103 of the hinge leaf 100 extends in the first (vertical) and second (depth) dimensions, and is substantially parallel to the plane defined by the first portion 101 of the hinge leaf 100.

The second portion 102 of the hinge leaf 100 extends from the first portion 101 of the hinge leaf 100 in the third (lateral) dimension. In the illustrated example, the second portion 102 extends from the first portion 101 at an angle of substantially 90 degrees, such that the first and second portions 101, 102 together define an L-shaped cross-section. However, this need not be the case in every example.

The third portion 103 of the hinge leaf 100 extends from the second portion 102 of the hinge leaf 100 in the second (depth) dimension. In the illustrated example, the third portion 103 extends from the second portion 102 at an angle of substantially 90 degrees, such that the second and third portions 102, 103 together define an L-shaped cross-section. However, this need not be the case in every example.

The hinge leaf 100 comprises a plurality of apertures 114-116 that are positioned at a corner interface between the second portion 102 and the third portion 103. The apertures 114-116 are spaced from one another in the first (vertical) dimension, along the corner interface, and are aligned with one another in the second (depth) and third (lateral) dimensions. Each of the apertures 114-116 is arranged to enable a fastener to pass through them to enable the hinge leaf 100 to be fixed to a sash of a door or a window.

In the illustrated example, the apertures 114-116 are shaped to enable the fasteners to pass through them at an angle of substantially 45 degrees relative to the second and third portions 102, 103 of the hinge leaf 100, in a plane defined in the second (depth) and third (lateral) dimensions.

The third portion 103 of the hinge leaf 100 comprises a plurality of apertures 117-118*a*, 118*b*, 118*c* and 119. The purpose of these apertures 117, 118*b*, 118*c*, 119 is described below.

Figure 4B:
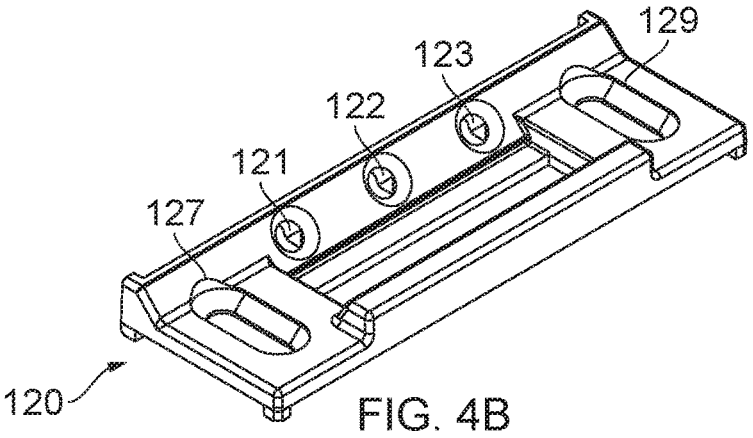
FIGS. 4B and 4C illustrate first and second perspective views of a clamp plate of the hinge respectively.
Figure 4C:
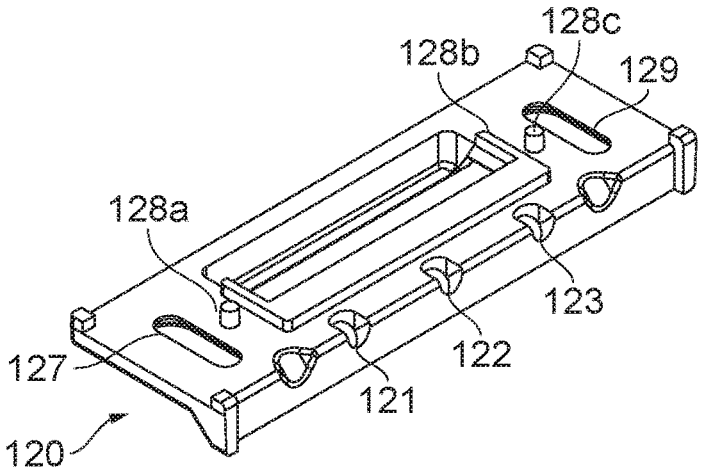

FIGS. 4A and 4B illustrate first and second perspective views of a clamp plate 120. The clamp plate 120 comprises a plurality of apertures 121-123, along a corner of the clamp plate 120 extending the first (vertical) dimension, that are arranged for alignment with the apertures 114-116 in the hinge leaf 100. The apertures 121-123 are spaced from one another in the first (vertical) dimension, along the corner of the clamp plate 120, and are aligned with one another in the second (depth) and third (lateral) dimensions. The clamp plate 120 also comprises apertures 127, 129 that are arranged for alignment with the corresponding apertures 117, 119 in the third portion 103 of the hinge leaf 100.

These apertures 117, 119, 127, 129 are also arranged for alignment with apertures 142, 143 in the clamp block 140 (see FIG. 1), such that fasteners (e.g. screws) can extend through the apertures 117, 119, 127, 129, 142, 143 in order to engage with a sash of a door/window and fix the hinge 10 to the sash.

The clamp plate 120 further comprises a plurality of protrusions 128*a*, 128*b*, 128*c* that are configured to be received in the apertures labelled with the reference numerals 118*a*, 118*b* and 118*c* respectively in the third portion 103 of the hinge leaf 100.

The clamp block 140 is configured to be positioned in a recess/channel of a sash of a door or window. The recess/channel may, for example, be a eurogroove. The clamp plate 120 and the clamp block 140 provide a clamping action when a first fastener is arranged to pass through the apertures labelled with the reference numerals 127, 117 and 143 and fasten to the sash, and when a second fastener is arranged to pass through the apertures labelled with the reference numerals 129, 119 and 142 and fasten to the sash.

Figure 5A:
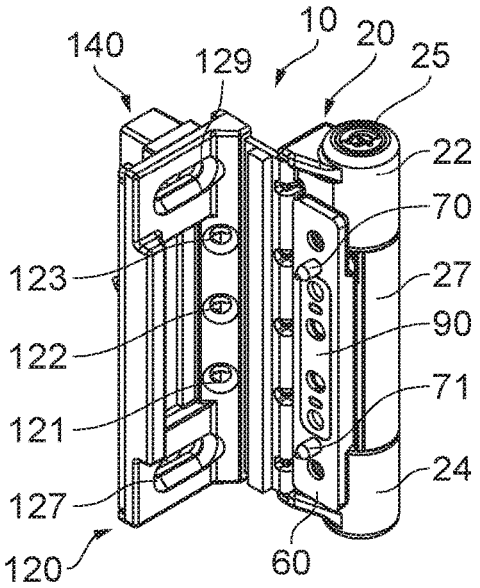
FIGS. 5A and 5B illustrate first and second perspective views of the hinge respectively.
Figure 5B:
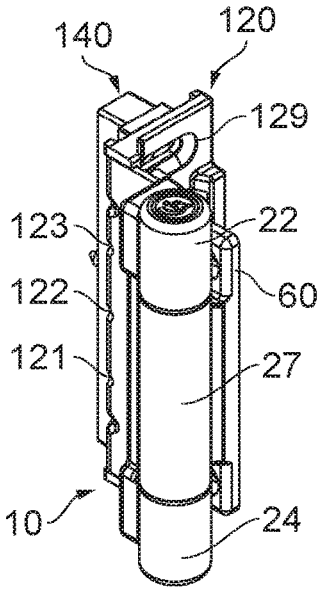
Figure 5C:
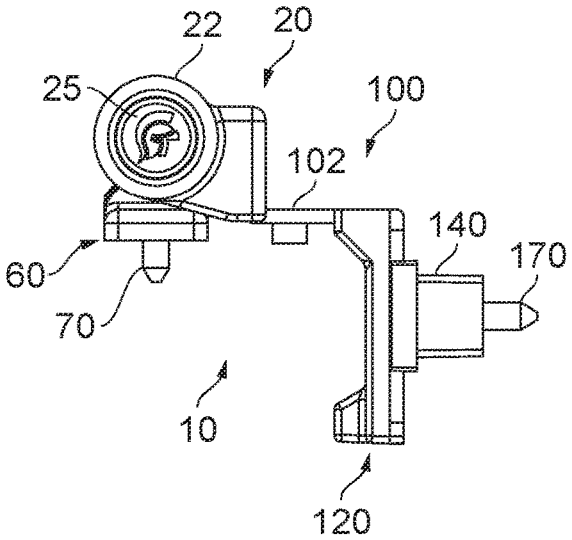
FIG. 5C illustrates a plan view of the hinge.
Figure 5D:
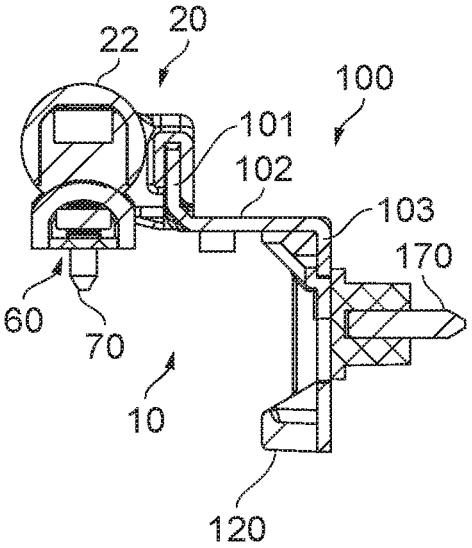
FIG. 5D illustrates a cross-sectional view of the hinge.

FIGS. 5A and 5B illustrate first and second perspective views of the hinge 10. FIG. 5C illustrates a plan view of the hinge 10. FIG. 5D illustrates a cross-sectional view of the hinge 10.

FIG. 5A illustrates the rear of the mount 60. It can be seen in FIG. 5A that the rear of the mount 60 comprises first and second protrusions 70, 71 that are configured to engage with a frame. One or more protrusions 170 extending from the clamp block 140 may also be configured to engage with the sash.

Figure 6A:
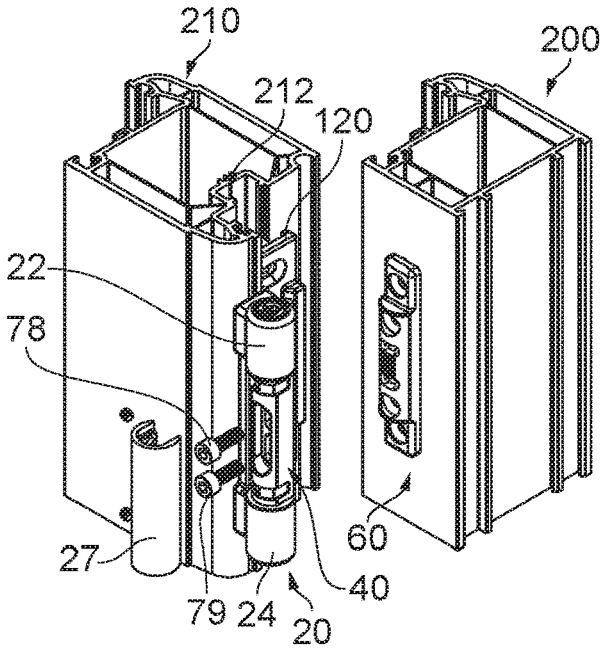
FIG. 6A illustrates a perspective view of the hinge being attached to a frame following attachment of the hinge to a sash.
Figure 6B:
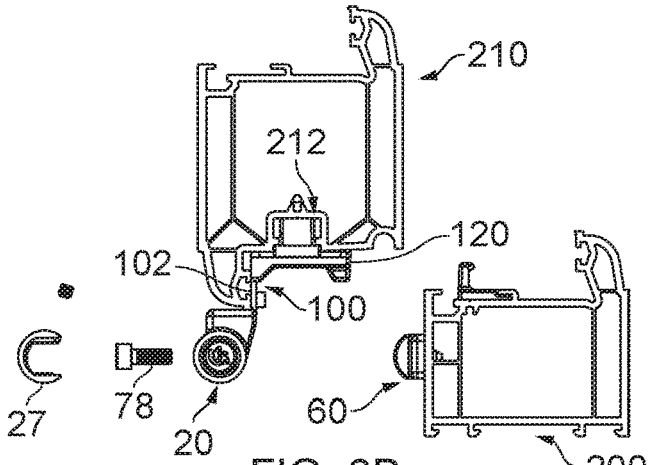
FIG. 6B illustrates a plan view of the arrangement illustrated in FIG. 6A.

FIGS. 6A and 6B illustrate the hinge 10 in the process of the hinge 10 being fitted to a frame 200 and a sash 210. In FIGS. 6A and 6B, the hinge 10 has been fixed into the channel 212 by means of fasteners passing through the apertures 114-116 in the hinge leaf 100, through the apertures 121-123 in the clamp plate 120 and into the sash 210, and by means of fasteners passing through the apertures 117, 119, 127, 129, 142 and 143 and into the sash 210. The fasteners may, for example, be screws.

It can be seen in FIG. 6B that the hinge leaf 100 and the clamp plate 120 are secured in a corner portion of the sash 210. Advantageously, the location of the apertures 114-116 in the corner interface of the hinge leaf 100 and along the corner of the clamp plate 120 enable secure and accurate positioning of the hinge leaf 100 and the clamp plate 120 in the corner portion of the sash 210.

The mount 60 has been fastened to the frame 200 in FIGS. 6A and 6B by fasteners extending through the first, second, third and fourth apertures 61-64 in the mount 60. The fasteners may, for example, be screws.

Once the clamp block 140 has been fixed into the channel 212 in the sash 210 and the mount 60 has been attached to the frame 200, the first and second fasteners 78, 79 are used to fix the mountable body 40 to the mount 60. As described above, the first and second fasteners 78, 79 pass through the apertures 46, 47 in the mountable body 40 and engage with the threaded passages 81, 82 in the first insert 80. The cover 27 may then be positioned over the mountable body 40 and secured using the fasteners 28, 29.

FIG. 7 illustrates a side elevation of the hinge 10. FIGS. 8A, 8B and 8C each illustrate a cross-section of the hinge 10, through the line X-X illustrated in FIG. 7, in a different compression adjustment position.

FIG. 9A illustrates a plan view of the hinge 10 in situ, which corresponds with the cross-sectional view of the hinge 10 illustrated in FIG. 8A. FIG. 9B illustrates a plan view of the hinge 10 in situ, which corresponds with the cross-sectional view of the hinge 10 illustrated in FIG. 8B. FIG. 9C illustrates a plan view of the hinge 10 in situ, which corresponds with a cross-sectional view of the hinge 10 illustrated in FIG. 8C.

It can be seen in FIGS. 8A to 9C how the hinge 10 may be adjusted to move a sash 210 to and from a frame 200 (to make a compression adjustment). In the example illustrated in FIGS. 8A and 9A, the user has adjusted the position of the fasteners 150, 151 in the threaded recesses 38, 39 (that are also located in the apertures 108, 109 of the hinge leaf 100) in order to adjust the position of the sash 210. Movement of the fasteners 150, 151 in the direction illustrated by the arrows 301 in FIGS. 8A and 9A causes the first portion 101 of the hinge leaf 100 and therefore the door sash 210 to move in the same direction.

In the example illustrated in FIGS. 8C and 9C, the user has adjusted the position of the fasteners 150, 151 in the threaded recesses 38, 39 in the direction identified by the arrow 302 in FIGS. 8C and 9C. Movement of the fasteners 150, 151 causes associated movement of the first portion 101 of the hinge leaf 100 within the elongate recess 37 in the housing 20, and results in movement of the door sash 210 in the same direction.

The direction labelled with the arrow 301 in FIGS. 8A and 9A is substantially opposite to the direction identified by the arrow 302 in FIGS. 8C and 9C. Both of the arrows 301, 302 identify directions in the second (depth) dimension and relate to a compression adjustment of the sash 210 relative to the frame 200.

FIGS. 10A, 10B and 10C each illustrate a front elevation of the hinge 210 in situ, in a different vertical adjustment position. FIG. 11A illustrates a perspective view of the hinge 10 in situ, which corresponds with the front elevation illustrated in FIG. 10A. FIG. 11B illustrates a perspective view of the hinge 10 in situ, which corresponds with the front elevation illustrated in FIG. 10B. FIG. 11C illustrates a perspective view of the hinge 10 in situ, which corresponds with the front elevation illustrated in FIG. 10C.

In FIGS. 10A and 11A, the position of the fasteners 78, 79 within the oversized apertures 46, 47 in the mountable body 40 has been adjusted by a user, relative to that shown in FIGS. 10B and 11B, in order to adjust the position of the mountable body 40 and the housing 20 relative to the mount 60. It can be seen in FIGS. 10A and 11A that the position of the fasteners 78, 79 is higher than that in FIGS. 10B and 11B, which results in (downwards) movement of the housing 20, the mountable body 40 and the door sash 210 in the direction identified by the arrow 303 in FIGS. 10A and 11A, relative to that shown in FIGS. 10B and 11B.

It can be seen in FIGS. 10C and 11C that a user has positioned the fasteners 78, 79 in the apertures 46, 47 in the mountable body 40 at a lower position than that in FIGS. 10B and 11B, resulting in (upwards) movement of the housing 20, the mountable body 40 and the door sash 210 in the direction identified by the arrow 304 in FIGS. 10C and 11C relative to that shown in FIGS. 10B and 11B.

The direction identified by the arrows labelled with the reference numeral 303 in FIGS. 10A and 11A is substantially opposite to that identified by the arrows labelled with the reference numeral 304 in FIGS. 10C and 11C. The directions identified by the arrows 303, 304 in FIGS. 10A, 10C, 11A and 11C are in the first (vertical) dimension and relate to a vertical adjustment of the door sash 210 relative to the frame 200.

FIGS. 12A, 12B and 12C illustrate a perspective view, a plan view and a cross-sectional view respectively of the hinge 10 in a first lateral adjustment position. FIGS. 13A, 13B and 13C illustrate a perspective view, a plan view and a cross-sectional view respectively of the hinge 10 in a second lateral adjustment position. FIGS. 14A, 14B and 14C illustrate a perspective view, a plan view and a cross-sectional view of the hinge 10 in a third lateral adjustment position.

In FIGS. 12A, 12B and 12C, the mountable body 40 has been secured against the mount 60 in a different position from that in FIGS. 13A, 13B and 13C, resulting in movement of the mountable body 40, the housing 20 and the door sash 210 in the direction identified by the arrows labelled with the reference numeral 305 in FIGS. 12A, 12B and 12C, relative to that shown in FIGS. 13A, 13B and 13C.

In FIGS. 14A, 14B and 14C, the mountable body 40 has been mounted against the mount 60 in a different position from that in FIGS. 13A, 13B and 13C, resulting in a movement of the housing 20, the mountable body 40 and the door sash 210 in the direction identified by the arrow labelled with the reference numeral 306 in FIGS. 14A, 14B and 14C, relative to that shown in FIGS. 13A, 13B and 13C.

The direction identified by the arrow 305 in FIGS. 12A, 12B and 12C is substantially opposite to the direction identified by the arrow labelled with the reference numeral 306 in FIGS. 14A, 14B and 14C. The directions identified by these arrows correspond with movement of the housing 20, the mountable body 40 and the door sash 210 in the third (lateral) dimension.

A hinge 10 has been described above that advantageously enables a user to adjust a position of a door sash 210 relative to a frame 200 in three orthogonal dimensions in a straightforward manner. Furthermore, advantageously, the hinge 10 has a relatively slim construction.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

The invention claimed is:

1. A hinge, comprising:

at least one hinge pin defining a hinge axis in a first dimension;

a hinge leaf;

a housing configured to rotatably receive the at least one hinge pin and comprising at least one recess defined along the first dimension for receiving a portion of the hinge leaf; and at least one user adjustable fastener adjustably mounted on the hinge leaf and threadably engaged to the housing and accessible from said recess for enabling adjustment of the positioning of the hinge leaf within the at least one recess in a second dimension, wherein the second dimension is orthogonal to the first dimension and is orthogonal to a plane aligned with and defining said recess.

2. The hinge of claim 1, wherein the at least one user adjustable fastener is configured to respond to user adjustment of the at least one user adjustable fastener and correspondingly adjust the positioning of the hinge leaf within the at least one recess in the second dimension.

3. The hinge of claim 1, wherein the at least one user adjustable fastener is at least one threaded fastener and the at least one recess comprises at least one thread for receiving the at least one threaded fastener.

4. The hinge of claim 1, wherein the hinge leaf is non-planar.

5. The hinge of claim 1, wherein the hinge leaf comprises a first portion that is for reception by the recess, and a second portion that extends from the first portion in a third dimension, the third dimension being orthogonal to the first dimension and the second dimension.

6. The hinge of claim 5, wherein the first portion is substantially planar and the second portion is substantially planar.

7. The hinge of claim 5, wherein the first portion and the second portion together define an L-shaped cross section.

8. The hinge of claim 5, wherein the hinge leaf further comprises a third portion that extends from the second portion in the second dimension.

9. The hinge of claim 8, wherein the third portion is substantially planar.

10. The hinge of claim 8, wherein a corner interface between the second portion and the third portion comprises one or more apertures for use in fixing the hinge leaf to a sash.

11. The hinge of claim 1, wherein the housing further comprises at least one sleeve for housing at least a portion of the at least one hinge pin.

12. The hinge of claim 11, the at least one hinge pin comprising a first hinge pin and a second hinge pin, wherein the at least one sleeve comprises a first sleeve and a second sleeve for respectively housing at least a portion of the first hinge pin and the second hinge pin of the at least one hinge pin, and the hinge further comprises a mountable body positioned between the first sleeve and the second sleeve, wherein the housing is configured to rotate about the hinge axis relative to the mountable body.

13. The hinge of claim 12, further comprising a mount for mounting the hinge to a frame, wherein the mountable body is configured to be adjustably mounted with the mount, and the mount is rotatable relative to the mountable body about a mounting axis extending in the first dimension, wherein the hinge is configured for user adjustment along the mounting axis when the mount and the mountable body are adjustably mounted.

14. The hinge of claim 13, wherein the mount comprises a first clamping surface for engaging with a second clamping surface of the mountable body.

15. The hinge of claim 14, further comprising at least one fastener for clamping the first clamping surface to the second clamping surface, and the mountable body comprises an aperture through which the at least one fastener is arranged to extend.

16. The hinge of claim 15, wherein the aperture is shaped to enable the position of the at least one fastener, within the aperture, to be user adjustable in the first dimension.

17. A hinge, comprising:

at least one hinge pin defining a hinge axis; and a hinge leaf, rotatable about the hinge axis, comprising a corner interface defining an apex between a pair of orthogonal walls comprising a portion of the hinge leaf and a further portion of the hinge leaf, wherein at least one aperture is provided in the corner interface for fixing the hinge leaf in place using a fastener, and the at least one aperture is disposed between and defined by respective wall portions of the pair of orthogonal walls defining the corner interface.

18. The hinge of claim 17, wherein the corner interface comprises a plurality of apertures for fixing the hinge leaf in place using a plurality of fasteners.

19. The hinge of claim 18, wherein the plurality of apertures includes a first aperture spaced from a second aperture, along the corner interface, in a first dimension.

20. A hinge, comprising:

at least one hinge pin defining a hinge axis, extending in a first dimension; and a hinge leaf, rotatable about the hinge axis, comprising a corner interface defining an apex between a pair of orthogonal walls comprising a portion of the hinge leaf and a further portion of the hinge leaf, a plurality of apertures being provided in the corner interface for fixing the hinge leaf in place using a plurality of fasteners, each aperture being spaced from another in the first dimension, and the plurality of apertures are disposed between and defined by respective wall portions of the pair of orthogonal walls defining the corner interface, and wherein each aperture is shaped to enable a fastener to pass therethrough at an angle of substantially 45 degrees, relative to the portion and the further portion of the hinge leaf, in a plane defined in second and third dimensions, each of the first, second and third dimensions being substantially orthogonal to each other.

* * * * *